US005669106A

United States Patent [19]

Daoud

[11] Patent Number: 5,669,106

[45] Date of Patent: Sep. 23, 1997

[54] HINGE MECHANISM

[75] Inventor: Bassel Hage Daoud, Parsippany, N.J.

[73] Assignee: Lucent Technologies Inc., Murray Hill, N.J.

[21] Appl. No.: 668,195

[22] Filed: Jun. 21, 1996

[51] Int. Cl.[6] ..... E05D 7/10

[52] U.S. Cl. ..... 16/266; 16/265

[58] Field of Search ..... 16/325, 334, 335, 16/337, 363, 371, 254, 255, 263, 266, 265

[56] References Cited

U.S. PATENT DOCUMENTS 2,963,734 12/1960 Huget ..... 16/266

*Primary Examiner*—Chuck Y. Mah
*Assistant Examiner*—Mark Williams

[57] ABSTRACT

A hinge mechanism for separably and pivotably connecting a base with a cover which is integrally molded with the base and the cover. The base has a first hinge body molded therewith, with the first hinge body having a cavity defined a longitudinal pivot axis. The cover has a second hinge body molded therewith and a pivot pin extending from the second hinge body, the pivot pin being receivable within the cavity of the base first hinge body. The second hinge body of the cover and the wall of the base are shaped in a cooperative manner so that there is interference between the second hinge body and the wall to prevent the pivot pin from being inserted into or removed from the first hinge body cavity except when the cover is in a predetermined angular position. In addition, the hinge bodies and the base and cover are formed with cooperating features which inhibit inadvertent pivoting movement of the cover from defined positions.

12 Claims, 2 Drawing Sheets

HINGE MECHANISM

BACKGROUND OF THE INVENTION

This invention relates to a hinge mechanism for separably and pivotably connecting a base with a cover and, more particularly, to such a mechanism which is integrally molded with the base and cover and provides detents for defined relative positions of the base and cover.

Separable hinge mechanisms for pivotably interconnecting a base with a cover are known, in general. Moreover, it is known to provide such a hinge mechanism which is integrally molded with the base and cover. However, when the base is mounted to a substantially vertical surface and the cover is pivoted about a substantially vertical pivot axis, a unitary molded hinge mechanism which provides stops, or detents, at defined angular positions of the cover is not generally available. Accordingly, there exists a need for such a hinge mechanism.

SUMMARY OF THE INVENTION

The present invention provides a hinge mechanism for separably and pivotably interconnecting a base with a cover where the base has a generally planar hinge wall portion terminated by a straight edge portion and the cover has a generally planar hinge wall portion terminated by a straight edge portion. The base hinge wall portion and the cover hinge wall portion are generally co-planar, with the base straight edge portion and the cover straight edge portion being closely adjacent each other when the cover is in an overlying (closed) position relative to the base. The hinge mechanism comprises a first hinge body which is secured to the base hinge wall portion and which has a generally cylindrical cavity defining a longitudinal axis and extending into the first hinge body from a first side thereof. The longitudinal axis is parallel to the base straight edge portion and defines a pivot axis for the hinge mechanism. A second hinge body is secured to the cover hinge wall portion, and a pivot pin having a longitudinal axis parallel to the cover straight edge portion is secured to the second hinge body for receipt within the first hinge body cavity with clearance to allow the pivot pin to rotate about the pivot axis. The base hinge wall portion is formed with a blocking wall parallel to and spaced from the first hinge body first side. The blocking wall and the first hinge body first side are planar and orthogonal to the pivot axis, with the distance between the first hinge body first side and the blocking wall being greater than the length of the second hinge body and less than the length of the second hinge body together with the length of the pivot pin so that the second hinge body can rotate in the space between the first hinge body and the blocking wall when the pivot pin is received within the first hinge body cavity. The blocking wall and the cross section of the second hinge body orthogonal to the pivot pin axis are so shaped that the blocking wall interferes with the second hinge body to prevent removal or insertion of the pivot pin from or into the first hinge body cavity except when the cover is in a predetermined angular orientation about the pivot axis relative to the base, the predetermined angular orientation corresponding to an engaging/disengaging position of the cover.

In accordance with an aspect of this invention, the base hinge wall portion is further formed with a rounded projection in the space between the first hinge body first side and the blocking wall. The orthogonal cross section of the second hinge body is further shaped to provide a plurality of detents which cooperate with the rounded projection when the cover is within a range of angular positions about the pivot axis, the range being bounded by the closed position and the engaging/disengaging position. The detents include a first detent when the cover is in the closed position and a second detent when the cover is in a defined angular orientation corresponding to a normal open position of the cover between the closed position and the engaging/disengaging position.

In accordance with another aspect of this invention, the base hinge wall portion is formed with a recess adjacent the first hinge body first side, the recess is terminated at a first end by the first hinge body first side and at a second end by the blocking wall, the second hinge body is rotatable within the recess when the pivot pin is received within the first hinge body cavity, the rounded projection extends into the recess, and the blocking wall and the rounded projection are contained entirely within the thickness of the base hinge wall portion.

In accordance with yet another aspect of this invention, the cover hinge wall portion is formed with a cantilevered beam within the plane of the cover hinge wall portion which extends toward the pivot pin so that the beam is positioned adjacent the first hinge body when the pivot pin is received within the first hinge body cavity. The cross section of the first hinge body orthogonal to the pivot axis is shaped so that (a) when the cover is in the closed position substantially no lateral force is applied to the beam by the first hinge body, (b) as the cover is moved between the closed position and the normal open position a first predetermined lateral force is applied to the beam by the first hinge body, (c) when the cover is in the normal open position substantially no lateral force is applied to the beam by the first hinge body, (d) as the cover is moved between the normal open position and the engaging/disengaging position a second predetermined lateral force is applied to the beam by the first hinge body, and (e) when the cover is in the engaging/disengaging position substantially no lateral force is applied to the beam by the first hinge body.

In accordance with a further aspect of this invention, the free end of the beam is at an acute angle to the plane of the beam, and the orthogonal cross section of the first hinge body is further shaped so that (f) when the cover is in the engaging/disengaging position the beam free end abuts a first complementarily angled wall of the first hinge body, and (g) when the cover is in the normal open position the beam free end abuts a second complementarily angled wall of the first hinge body. Accordingly, a first predetermined torque on the cover is required to laterally deflect the beam in order to move the cover from the engaging/disengaging position toward the normal open position and a second predetermined torque on the cover is required to laterally deflect the beam in order to move the cover from the normal open position toward the closed position.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 3A:
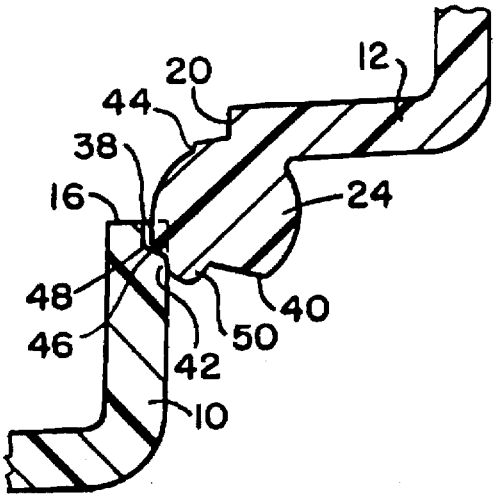
Figure 3B:
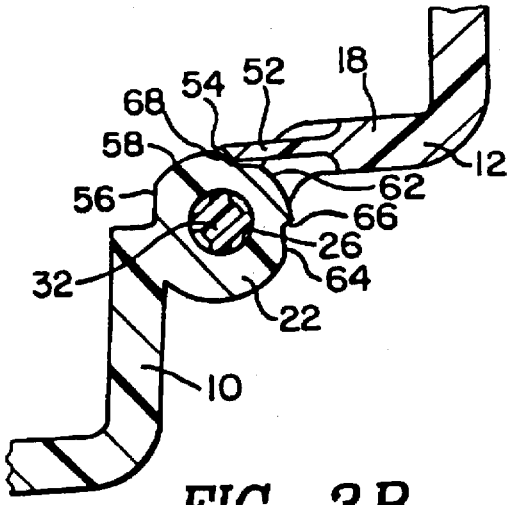
Figure 4A:
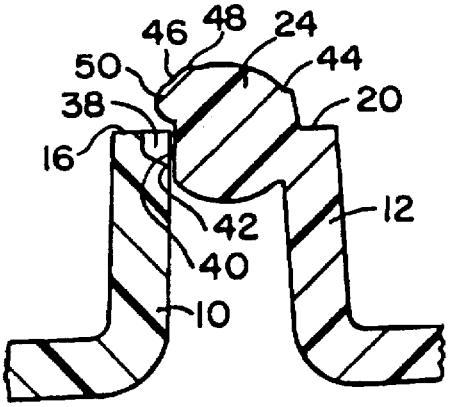
Figure 4B:
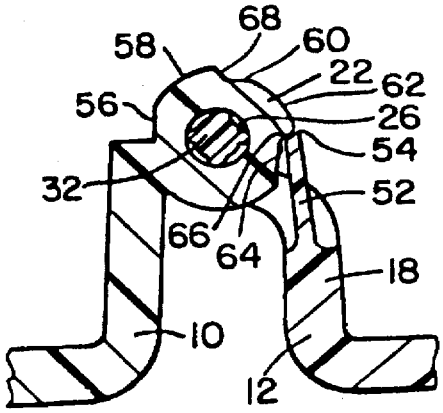

Referring now to the drawings, illustrated therein is a portion of a base member 10 and a cover member 12 which are separably and pivotably connected together by a hinge mechanism constructed in accordance with the principles of this invention. Thus, the cover member 12 is pivotable bi-directionally about a pivot axis relative to the base member 10 from an overlying (closed) position (FIGS. 2A and 2B) to a normal open position (FIGS. 3A and 3B) and to an engaging/disengaging position (FIGS. 4A and 4B).

Figure 2A:
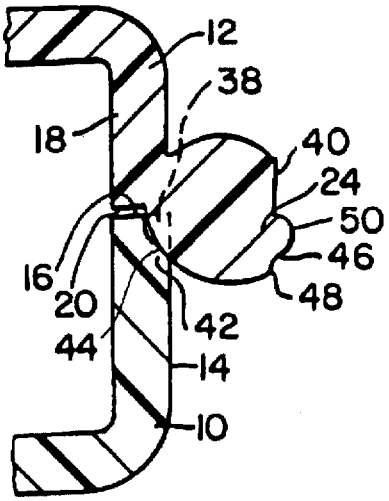
FIGS. 2A, 3A and 4A are schematic cross sectional views taken along the line A—A in FIG. 1 showing the inventive hinge mechanism in the closed, normal open and engaging/disengaging positions, respectively.

The base member 10 and the cover member 12 are molded of a plastic material and the inventive hinge mechanism for interconnecting them is molded unitarily with the base member 10 and the cover member 12. The base member 10 has a generally planar hinge wall portion 14 terminated by a straight edge portion 16 and the cover member 12 has a generally planar hinge wall portion 18 terminated by a straight edge portion 20. As best seen in FIG. 2A, when the cover member 12 is in the closed position, the hinge wall portion 14 of the base member 10 and the hinge wall portion 18 of the cover member 12 are generally co-planar and the straight edge portions 16, 20 are closely adjacent each other.

The inventive hinge mechanism includes a first hinge body 22 molded unitarily with the base member 10 adjacent the straight edge portion 16 of the hinge wall portion 14 and a second hinge body 24 molded unitarily with the cover member 12 adjacent the straight edge portion 20 of the hinge wall portion 18. The first hinge body 22 has a generally cylindrical cavity 26 which extends into the hinge body 22 from a first side 28 and defines a longitudinal axis 30. (Although the cavity 26 is shown as a through-bore, it is understood that it may only extend part way into the hinge body 22 from the first side 28.) The longitudinal axis 30 is parallel to the straight edge portion. 16 of the hinge wall portion 14 and defines a pivot-axis for the inventive hinge mechanism. Although the hinge body 22 is generally cylindrical, its outer periphery is formed to provide several functions, as will be described in full detail hereinafter.

The second hinge body 24 is also generally cylindrical, with its outer periphery formed to provide several functions, to be described in full detail hereinafter. A pivot pin 32 having a longitudinal axis 34 parallel to the straight edge portion 20 of the hinge wall portion 18 of the base cover member 12 extends away from the second hinge body 24 and is formed unitarily therewith. The pivot pin 32 is adapted to be received within the cavity 26 of the hinge body 22 with slight clearance to allow the pivot pin 32 to rotate therein with the longitudinal axis 34 of the pivot pin 32 being co-linear with the longitudinal axis 30 of the cavity 26. Accordingly, when the pivot pin 32 is received within the cavity 26, the cover member 12 is pivotable relative to the base member 10 about the axis 30.

The wall portion 14 of the base member 10 is formed with a recess 36 open to the straight edge portion 16 and adjacent the side 28 of the hinge body 22. The recess 36 is terminated at a first end by the side 28 of the hinge body 22 and at a second end by a blocking wall 38. The blocking wall 38 and the side 28 of the hinge body 22 are parallel to each other and orthogonal to the axis 30. The length of the recess 36 (i.e., the distance between the side 28 and the blocking wall 38) is slightly greater than the length of the hinge body 24 along the longitudinal axis 34 so that when the pivot pin 32 is received within the cavity 26, the hinge body 24 is rotatable within the recess 36.

According to the present invention, the pivot pin 32 can be inserted into or removed from the cavity 26 only when the cover member 12 is in a predetermined angular orientation about the pivot axis 30 relative to the base member 10. This is accomplished by shaping the cross section of the hinge body 24 orthogonal to the axis 34 so that it interferes with the blocking wall 38 except when the cover member 12 is in that predetermined angular orientation. Thus, as shown in FIG. 2A, when the cover member 12 is in the closed position, there is an overlap of the hinge body 24 with the blocking wall 38 to prevent longitudinal movement along the axis 30 of the cover member 12. As shown in FIG. 3A, where the cover member 12 is in its normal open position, the same overlap prevails. However, the hinge body 24 is cut away at 40 so that when the cover member 12 is rotated to the predetermined angular orientation designated as the engaging/disengaging position shown in FIG. 4A, the hinge body 24 is clear of the blocking wall 38 so that the cover member 12 can be moved longitudinally along the axis 30 to install the pivot pin 32 into, or remove the pivot pin 32 from, the cavity 26.

In a particular application which provided an incentive for the inventive hinge mechanism, the base member 10 and the cover member 12 are mounted with the pivot axis 30 being substantially vertical. Further, an outdoor installation was contemplated and it was desired to prevent the cover member from being moved from an intended position inadvertently, as, for example, by a gust of wind. Accordingly, the inventive hinge mechanism is designed to require that certain minimum forces be applied to the cover member 12 to move it into and out of its defined closed, normal open and engaging/disengaging positions.

Figure 1:
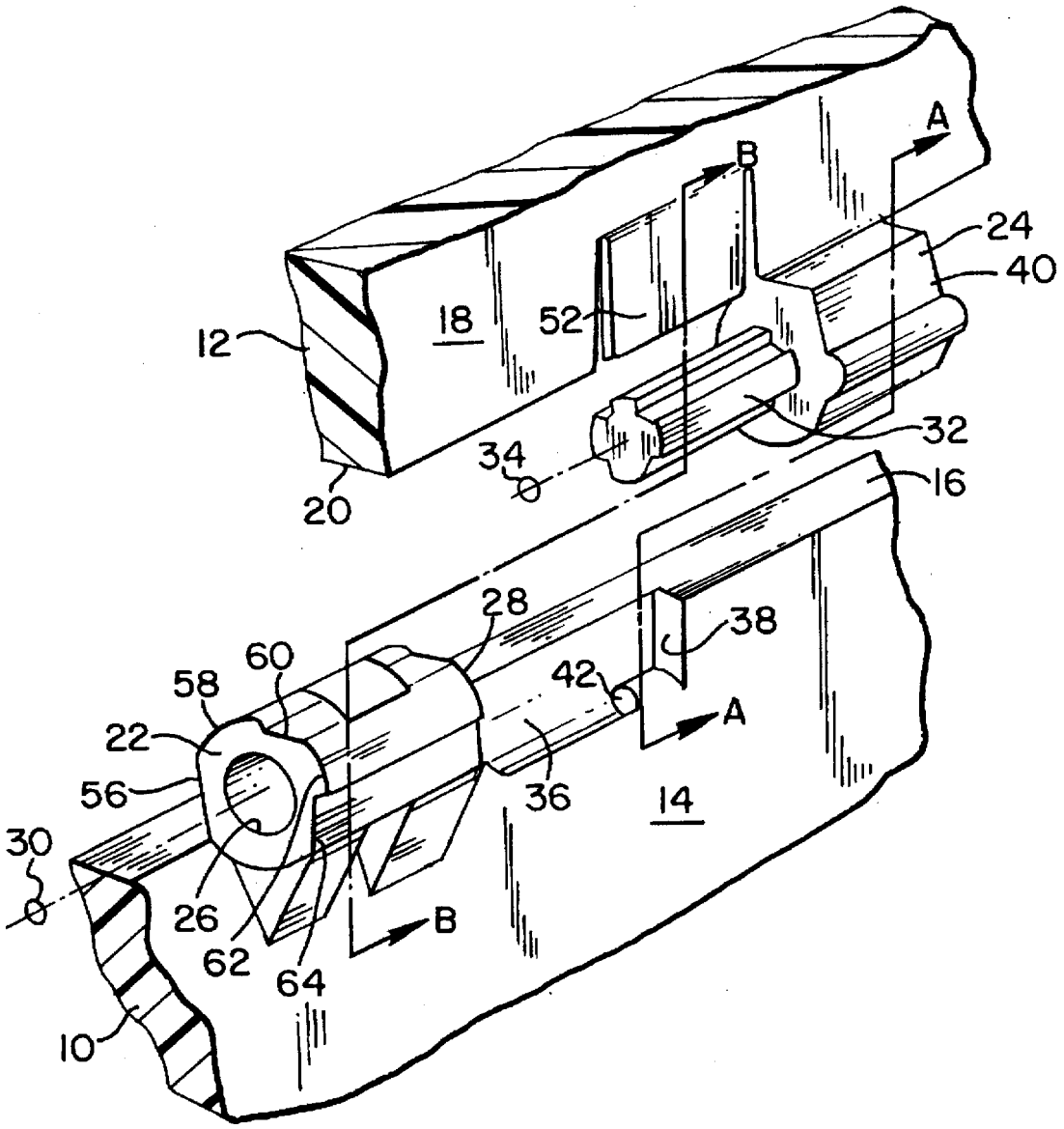
FIG. 1 is an exploded perspective view of a hinge mechanism constructed in accordance with the principles of this invention.

Extending into the recess 36 from its lower edge is a rounded projection 42. It is noted that in FIG. 1 the rounded projection 42 is illustrated as extending only partially along the length of the recess 36, however, the projection 42 may, under certain circumstances, encompass the entire length of the recess 36. In any event, both the projection 42 and the blocking wall 38 are contained entirely within the thickness of the hinge wall portion 14. The cross section of the hinge body 24 orthogonal to the recess 36 is further shaped to provide a plurality of detents which cooperate with the projection 42. These detents are used to define the closed position and the normal open position of the cover member 12 and to require a certain force for removing the cover member 12 from the closed position toward the normal open position and from the normal open position either toward the closed position or toward the engaging/disengaging position.

Thus, when the cover member 12 is in the closed position, a recess 44 forming a first detent is adjacent the projection 42, as shown in FIG. 2A. To move the cover member 12 from the closed position toward the normal open position, sufficient force must be exerted on the cover member 12 to cause a temporary deformation which allows the outwardly extending region of the hinge body 24 between the recess 44 and the second recess, or detent, 46 to pass the projection 42. The second detent 46 is adjacent the projection 42 when the cover member 12 is in the normal open position, as shown in FIG. 3A. Flanking the recess 46 are bulges 48, 50 which require a minimum deformation force to move the cover member 12 out of the normal open position. In particular, the enlarged bulge 50 inhibits inadvertent movement of the cover member 12 to the engaging/disengaging position.

Figure 2B:
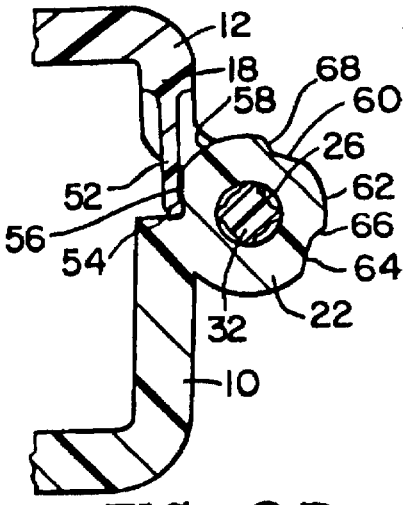
FIGS. 2B, 3B and 4B are schematic cross sectional views taken along the line B—B in FIG. 1 showing the inventive hinge mechanism in the closed, normal open and engaging/disengaging positions, respectively.

To resist movement of the cover member 12 in the closing direction, the hinge wall portion 18 of the cover member 12 is formed with a cantilevered beam 52 within the plane of the wall 18. The beam 52 extends toward the pivot pin 32 and its free end 54 is formed at an acute angle relative to the plane of the beam 52. The free end 54 is positioned adjacent the hinge body 22 when the cover member 12 is interconnected with the base member 10 and the periphery of the hinge body 22 is shaped to function like a cam, with the beam 52 functioning as a cam follower. Thus, as shown in FIG. 2B, when the cover member 12 is in the closed position, the beam 52 is adjacent the cut away portion 56 of the hinge body 22 with no, or very slight, contact therebetween so that substantially no lateral force is applied to the beam 52 by the hinge body 22. As the cover member 12 is moved toward the normal open position, the beam 52 rides over a ramped portion 58 of the hinge body 22, which causes a first predetermined lateral force to be applied to the beam 52. When the cover member 12 is in the normal open position, as shown in FIG. 3B, the beam 52 is adjacent another cut away portion 60 so that substantially no lateral force is applied to the beam 52. As the cover member 12 is moved from the normal open position toward the engaging/disengaging position, the beam 52 rides over the ramped portion 62, so that a second predetermined lateral force is applied to the beam 52. When the cover member 12 is in the engaging/disengaging position, as shown in FIG. 4B, the beam 52 is adjacent the cut away portion 64 so that substantially no lateral force is applied to the beam 52.

With the cover member 12 in the engaging/disengaging position, as shown in FIG. 4B, the angled free end 54 of the beam 52 abuts a complementary angled wall 66 on the hinge body 22 which is a transition between the cut away portion 64 and the ramped portion 62. Accordingly, to move the cover member 12 from the engaging/disengaging position toward the normal open position, a first predetermined torque must be applied to the cover member 12 to laterally deflect the beam 52 from the cut away portion 64 to the ramped portion 62. Similarly, when the cover member 12 is in the normal open position, as shown in FIG. 3B, the angled free end 54 of the beam 52 abuts a complementary angled wall 68 on the hinge body 22 which is a transition between the cut away portion 60 and the ramped portion 58. Accordingly, in order to move the cover member 12 from the normal open position toward the closed position, a second predetermined torque must be applied to the cover member 12 to laterally deflect the beam 52 from the cut away portion 60 to the ramped portion 58. Thus, it is unlikely that a gust of wind, or an inadvertent brushing against the cover member 12, will inadvertently move the cover member 12 from its intended position.

The dimensions of the projection 42, the periphery of the hinge body 24, the beam 52 and the periphery of the hinge body 22 may be chosen in accordance with whatever minimum forces for moving the cover member 12 are desired.

Accordingly, there has been disclosed an improved hinge mechanism for separably and pivotably connecting a base member with a cover member. While a preferred embodiment of the present invention has been disclosed herein, it will be apparent to one of ordinary skill in the art that various modifications and adaptations to the disclosed embodiment are possible and it is intended that this invention be limited only by the scope of the appended claims.

What is claimed is:

1. A hinge mechanism for separably and pivotably interconnecting a base member with a cover member, said base member having a generally planar hinge wall portion terminated by a straight edge portion, said cover member having a generally planar hinge wall portion terminated by a straight edge portion, the base member hinge wall portion and the cover member hinge wall portion being generally co-planar with the base member straight edge portion and the cover member straight edge portion being closely adjacent each other when the cover member is in an overlying (closed) position relative to the base member, the hinge mechanism comprising:

a first hinge body secured to said base member hinge wall portion, said first hinge body having a generally cylindrical cavity defining a longitudinal axis and extending into said first hinge body from a first side thereof, said longitudinal axis being parallel to said base member straight edge portion and defining a pivot axis for said hinge mechanism;

a second hinge body secured to said cover member hinge wall portion;

a pivot pin having a longitudinal axis parallel to said cover member straight edge portion, said pivot pin being secured to said second hinge body and adapted to be received within said first hinge body cavity with clearance to allow said pivot pin to rotate about said pivot axis;

said base member hinge wall portion being formed with a blocking wall parallel to and spaced from said first hinge body first side, said blocking wall and said first hinge body first side being planar and orthogonal to said pivot axis, the distance between said first hinge body first side and said blocking wall being greater than the length of said second hinge body and less than the length of said second hinge body together with the length of said pivot pin so that said second hinge body can rotate in the space between said first hinge body and said blocking wall when said pivot pin is received within said first hinge body cavity;

said blocking wall and a cross section of said second hinge body orthogonal to said pivot pin axis being so shaped that said blocking wall interferes with said second hinge body to prevent removal or insertion of said pivot in from or into said first hinge body cavity except when said cover member is in a predetermined angular orientation about said pivot axis relative to said base member, said predetermined angular orientation corresponding to an engaging/disengaging position of said cover member; and said base member hinge wall portion is further formed with a rounded projection in the space between said first hinge body first side and said blocking wall, and the orthogonal cross section of said second hinge body is further shaped to provide a plurality of detents which cooperate with said rounded projection when said cover member is within a range of angular positions about said pivot axis, said range being bounded by said closed position and said engaging/disengaging position.

2. The hinge mechanism according to claim 1 wherein said plurality of detents includes:

(a) a first detent when said cover member is in said closed position; and (b) a second detent when said cover member is in a defined angular orientation corresponding to a normal open position of said cover member between said closed position and said engaging/disengaging position.

3. The hinge mechanism according to claim 1 wherein:

said base member hinge wall portion is formed with a recess adjacent said first hinge body first side;

said recess is terminated at a first end by said first hinge body first side and at a second end by said blocking wall;

said second hinge body is rotatable within said recess when said pivot pin is received within said first hinge body cavity;

said rounded projection extends into said recess; and said blocking wall and said rounded projection are contained entirely within the thickness of said base member hinge wall portion.

4. The hinge mechanism according to claim 1 wherein:

said cover member hinge wall portion is formed with a cantilevered beam within the plane of said cover member hinge wall portion and extending toward said pivot pin so that said beam is positioned adjacent said first hinge body when said pivot pin is received within said first hinge body cavity; and the cross section of said first hinge body orthogonal to said pivot axis is shaped so that:

(a) when said cover member is in said closed position substantially no lateral force is applied to said beam by said first hinge body;

(b) as said cover member is moved between said closed position and said normal open position a first predetermined lateral force is applied to said beam by said first hinge body;

(c) when said cover member is in said normal open position substantially no lateral force is applied to said beam by said first hinge body;

(d) as said cover member is moved between said normal open position and said engaging/disengaging position a second predetermined lateral force is applied to said beam by said first hinge body; and (e) when said cover member is in said engaging/disengaging position substantially no lateral force is applied to said beam by said first hinge body.

5. The hinge mechanism according to claim 4 wherein:

the free end of said beam is at an acute angle to the plane of said beam; and the orthogonal cross section of said first hinge body is further shaped so that:

(f) when said cover member is in said engaging/disengaging position said beam free end abuts a first complementarily angled wall of said first hinge body; and (g) when said cover member is in said normal open position said beam free end abuts a second complementarily angled wall of said first hinge body;

whereby a first predetermined torque on said cover member is required to laterally deflect said beam in order to move said cover member from said engaging/disengaging position toward said normal open position and a second predetermined torque on said cover member is required to laterally deflect said beam in order to move said cover member from said normal open position toward said closed position.

6. The hinge mechanism according to claim 1 wherein:

said base member and said first hinge body are together part of a first unitary molded piece; and said cover member, said second hinge body and said pivot pin are together part of a second unitary molded piece.

7. A hinge mechanism for separably and pivotably interconnecting a base member with a cover member, said base member having a generally planar hinge wall portion terminated by a straight edge portion, said cover member having a generally planar hinge wall portion terminated by a straight edge portion, the base member hinge wall portion and the cover member hinge wall portion being generally co-planar with the base member straight edge portion and the cover member straight edge portion being closely adjacent each other when the cover member is in an overlying (closed) position relative to the base member, the hinge mechanism comprising:

a first hinge body secured to said base member hinge wall portion, said first hinge body having a generally cylindrical cavity defining a longitudinal axis and extending into said first hinge body from a first side thereof, said longitudinal axis being parallel to said base member straight edge portion and defining a pivot axis for said hinge mechanism;

a second hinge body secured to said cover member hinge wall portion;

a pivot pin having a longitudinal axis parallel to said cover member straight edge portion, said pivot pin being secured to said second hinge body and adapted to be received within said first hinge body cavity with clearance to allow said pivot pin to rotate about said pivot axis;

said base member hinge wall portion being formed with a blocking wall parallel to and spaced from said first hinge body first side, said blocking wall and said first hinge body first side being planar and orthogonal to said pivot axis, the distance between said first hinge body first side and said blocking wall being greater than the length of said second hinge body and less than the length of said second hinge body together with the length of said pivot pin so that said second hinge body can rotate in the space between said first hinge body and said blocking wall when said pivot pin is received within said first hinge body cavity;

said blocking wall and a cross section of said second hinge body orthogonal to said pivot pin axis being so shaped that said blocking wall interferes with said second hinge body to prevent removal or insertion of said pivot pin from or into said first hinge body cavity except when said cover member is in a predetermined angular orientation about said pivot axis relative to said base member, said predetermined angular orientation corresponding to an engaging/disengaging position of said cover member;

said cover member hinge wall portion is formed with a cantilevered beam within the plane of said cover member hinge wall portion and extending toward said pivot pin so that said beam is positioned adjacent said first hinge body when said pivot pin is received within said first hinge body cavity; and the cross section of said first hinge body orthogonal to said pivot axis is shaped so that:

(a) when said cover member is in said closed position substantially no lateral force is applied to said beam by said first hinge body;

(b) as said cover member is moved between said closed position and said normal open position a first predetermined lateral force is applied to said beam by said first hinge body;

(c) when said cover member is in said normal open position substantially no lateral force is applied to said beam by said first hinge body;

(d) as said cover member is moved between said normal open position and said engaging/disengaging position a second predetermined lateral force is applied to said beam by said first hinge body; and (e) when said cover member is in said engaging/disengaging position substantially no lateral force is applied to said beam by said first hinge body.

8. The hinge mechanism according to claim 7 wherein:

said base member hinge wall portion is further formed with a rounded projection in the space between said first hinge body first side and said blocking wall, and the orthogonal cross section of said second hinge body is further shaped to provide a plurality of detents which cooperate with said rounded projection when said cover member is within a range of angular positions about said pivot axis, said range being bounded by said closed position and said engaging/disengaging position.

9. The hinge mechanism according to claim 8 wherein said plurality of detents includes:

(a) a first detent when said cover member is in said closed position; and (b) a second detent when said cover member is in a defined angular orientation corresponding to a normal open position of said cover member between said closed position and said engaging/disengaging position.

10. The hinge mechanism according to claim 8 wherein:

said base member hinge wall portion is formed with a recess adjacent said first hinge body first side;

said recess is terminated at a first end by said first hinge body first side and at a second end by said blocking wall;

said second hinge body is rotatable within said recess when said pivot pin is received within said first hinge body cavity;

said rounded projection extends into said recess; and said blocking wall and said rounded projection are contained entirely within the thickness of said base member hinge wall portion.

11. The hinge mechanism according to claim 7 wherein:

the free end of said beam is at an acute angle to the plane of said beam; and the orthogonal cross section of said first hinge body is further shaped so that:

(f) when said cover member is in said engaging/disengaging position said beam free end abuts a first complementarily angled wall of said first hinge body; and (g) when said cover member is in said normal open position said beam free end abuts a second complementarily angled wall of said first hinge body;

whereby a first predetermined torque on said cover member is required to laterally deflect said beam in order to move said cover member from said engaging/disengaging position toward said normal open position and a second predetermined torque on said cover member is required to laterally deflect said beam in order to move said cover member from said normal open position toward said closed position.

12. The hinge mechanism according to claim 7 wherein:

said base member and said first hinge body are together part of a first unitary molded piece; and said cover member, said second hinge body and said pivot pin are together part of a second unitary molded piece.

* * * * *